US012258859B1

(12) United States Patent
Jones et al.

(10) Patent No.: US 12,258,859 B1
(45) Date of Patent: Mar. 25, 2025

(54) CONTINUOUS SEPARATION OF MULTI-PHASE FORMATION FLUIDS DURING DOWNHOLE SAMPLING AND MEASURING

(71) Applicant: Halliburton Energy Services, Inc., Houston, TX (US)

(72) Inventors: Christopher Michael Jones, Houston, TX (US); James Martin Price, Cypress, TX (US); Wael Elhawary, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/387,158

(22) Filed: Nov. 6, 2023

Related U.S. Application Data

(60) Provisional application No. 63/546,451, filed on Oct. 30, 2023.

(51) Int. Cl.
*E21B 49/08* (2006.01)

(52) U.S. Cl.
CPC ..... *E21B 49/08* (2013.01)

(58) Field of Classification Search
CPC ..... E21B 43/38; E21B 49/08; E21B 49/087; E21B 49/0875; E21B 49/10
See application file for complete search history.

(56) References Cited

U.S. PATENT DOCUMENTS 7,231,819 B2 * 6/2007 Jones ..... E21B 49/08 73/61.55
7,575,681 B2 * 8/2009 Angelescu ..... E21B 49/081 210/257.2
7,748,266 B2 * 7/2010 Evrard ..... E21B 49/005 73/152.23
8,215,388 B2 * 7/2012 van Zuilekom ..... E21B 49/08 166/264
8,262,909 B2 * 9/2012 Angelescu ..... B01D 67/0062 210/257.2
8,616,272 B2 * 12/2013 Mazyar ..... E21B 43/385 210/488
10,126,287 B2 * 11/2018 Irani ..... B01F 23/405
10,208,591 B2 * 2/2019 Smythe ..... E21B 49/10
(Continued)

FOREIGN PATENT DOCUMENTS

WO 2014100027 A2 6/2014

OTHER PUBLICATIONS

International Search Report & Written Opinion; PCT Application No. PCT/US2023/036952; mailed Jul. 23, 2024.

*Primary Examiner* — Jennifer H Gay
(74) *Attorney, Agent, or Firm* — NOVAK DRUCE CARROLL LLP

(57) ABSTRACT

Systems and methods are provided for facilitating continuous affinity-based separation of phases in multi-phase formation fluid in a downhole environment. A system can comprise a formation sampler that samples a formation to gather multi-phase formation fluid in a continuous flow through a wellbore during a testing pump out of the formation. The system can also comprise a phase separator comprising one or more affinity-based separators that continuously separates one or more phases of the multi-phase formation fluid through either or both diffusion or flow while downhole in the wellbore during the testing pump out.

18 Claims, 8 Drawing Sheets

(56) References Cited

U.S. PATENT DOCUMENTS

| | | | | |
|---|---|---|---|---|
| 10,344,592 | B2 * | 7/2019 | Pirolli | E21B 49/08 |
| 11,333,017 | B2 * | 5/2022 | Pfeiffer | E21B 49/08 |
| 11,808,150 | B2 * | 11/2023 | Pfeiffer | E21B 43/38 |
| 2004/0045350 | A1 * | 3/2004 | Jones | E21B 49/10 73/152.23 |
| 2006/0008913 | A1 * | 1/2006 | Angelescu | B01D 19/0031 436/28 |
| 2009/0293605 | A1 * | 12/2009 | Evrard | E21B 49/005 73/152.25 |
| 2010/0012586 | A1 * | 1/2010 | Angelescu | B01D 65/08 210/637 |
| 2010/0089569 | A1 * | 4/2010 | van Zuilekom | E21B 49/10 166/264 |
| 2012/0043072 | A1 * | 2/2012 | Mazyar | E21B 43/385 166/105.5 |
| 2012/0285680 | A1 * | 11/2012 | Kumar | E21B 49/08 166/264 |
| 2013/0175036 | A1 * | 7/2013 | Hausot | E21B 27/00 166/57 |
| 2016/0319663 | A1 | 11/2016 | Natali | |
| 2017/0045490 | A1 * | 2/2017 | Irani | E21B 49/08 |
| 2017/0175521 | A1 * | 6/2017 | Pirolli | E21B 49/08 |
| 2017/0175522 | A1 * | 6/2017 | Smythe | E21B 49/08 |
| 2017/0370210 | A1 | 12/2017 | Nyhavn et al. | |
| 2020/0318477 | A1 * | 10/2020 | Pfeiffer | E21B 49/10 |
| 2022/0341318 | A1 | 10/2022 | Garcia et al. | |
| 2024/0240558 | A1 * | 7/2024 | Andrews | E21B 47/114 |

* cited by examiner

CONTINUOUS SEPARATION OF MULTI-PHASE FORMATION FLUIDS DURING DOWNHOLE SAMPLING AND MEASURING

CROSS-REFERENCE TO RELATED APPLICATIONS

This application claims benefit of U.S. Provisional Application No. 63/546,451 filed Oct. 30, 2023, which is incorporated herein by reference.

TECHNICAL FIELD

The present technology relates generally to facilitating continuous affinity-based separation of phases in multi-phase formation fluid in a downhole environment, and more particularly to using one or more affinity-based separators to continuously separate one or more phases of multi-phase formation fluid in a downhole environment.

BACKGROUND

Formation evaluation operations use formation testing tools to both measure and sample downhole fluids. These fluids can exist as multi-phase, e.g. oil and water, fluids which can hinder or compromise the measuring and sampling tasks that are performed by such formation testing tools. Specifically, the multi-phase aspects of formation fluids can make it difficult to continuously sample and accurately characterize the formation.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
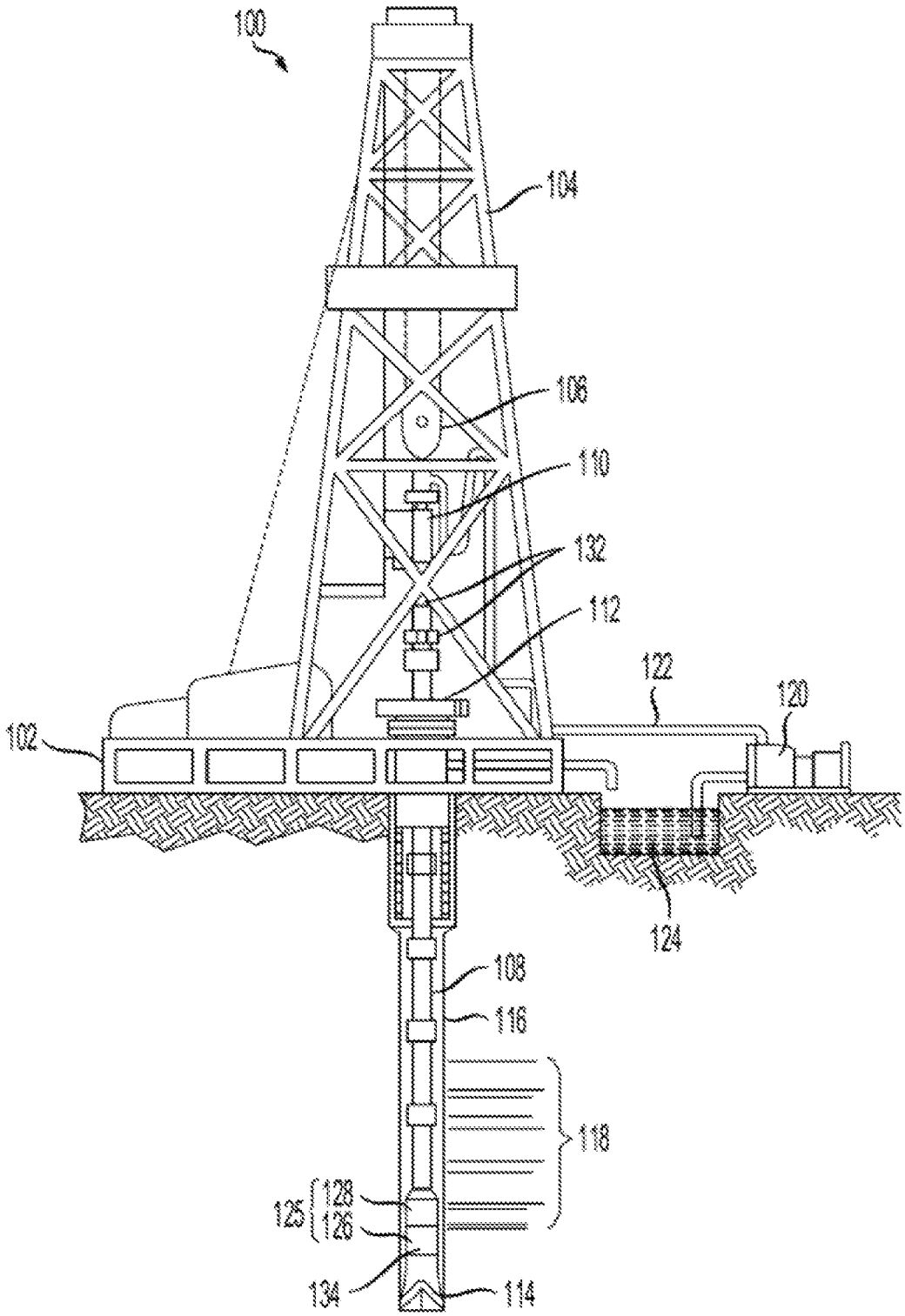
FIG. 1A is a schematic diagram of an example logging while drilling (LWD) wellbore operating environment, in accordance with some examples.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

As discussed previously, formation evaluation operations use formation testing tools to both measure and sample downhole fluids. These fluids can exist as multi-phase, e.g. oil and water, fluids which can hinder or compromise the measuring and sampling tasks that are performed by such formation testing tools. Specifically, the multi-phase aspects of formation fluids can make it difficult to continuously sample and accurately characterize the formation fluid.

Mechanical techniques have been implemented to separate formation fluid phases to obtain representative samples and make measurements. However, these mechanical-based techniques have numerous drawbacks. First, the use of mechanical systems to separate phases of formation fluid can lead to non-continuous sampling and subsequent measuring of the formation fluid. Further, the use of mechanical systems to separate phases of formation fluid can fractionate/precipitate the sample into constituent components. In turn, this can yield a fluid that is not compositionally representative of the native formation fluid when making measurements of the fluid.

The disclosed technology addresses the foregoing by using one or more affinity-based separators to continuously separate one or more phases of multi-phase formation fluid in a downhole environment. Specifically, affinity-based separators that are sensitive to water and oil can be used to continuously separate one or more phases of multi-phase formation fluid in one or more stages while maintaining the intended single phase fluid composition of each phase of the multi-phase formation fluid.

The disclosure now turns to FIG. 1A, which illustrates a schematic view of a logging while drilling (LWD) wellbore operating environment 100 in in accordance with some examples of the present disclosure. As depicted in FIG. 1A, a drilling platform 102 can be equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, the drill bit 114 creates a wellbore 116 that passes through various formations 118. A pump 120 circulates drilling fluid through a supply pipe 122 to top drive 110, down through the interior of drill string 108 and orifices in drill bit 114, back to the surface via the annulus around drill string 108, and into a retention pit 124. The drilling fluid transports cuttings from the wellbore 116 into the retention pit 124 and aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the drill bit 114 extends the wellbore 116 through the formations 118, logging tools 126 collect measurements relating to various formation properties as well as the orientation of the tool and various other drilling conditions. The bottom-hole assembly 125 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled with one or more wires and/or other media. The logging tools 126 may also include one or more computing devices 134 communicatively coupled with one or more of the one or more tool components by one or more wires and/or other media. The one or more computing devices 134 may be configured to control or monitor a performance of the tool, process logging data, and/or carry out one or more aspects of the methods and processes of the present disclosure.

In at least some instances, one or more of the logging tools 126 may communicate with a surface receiver 132 by a wire, such as wired drillpipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drillpipe.

Figure 1B:
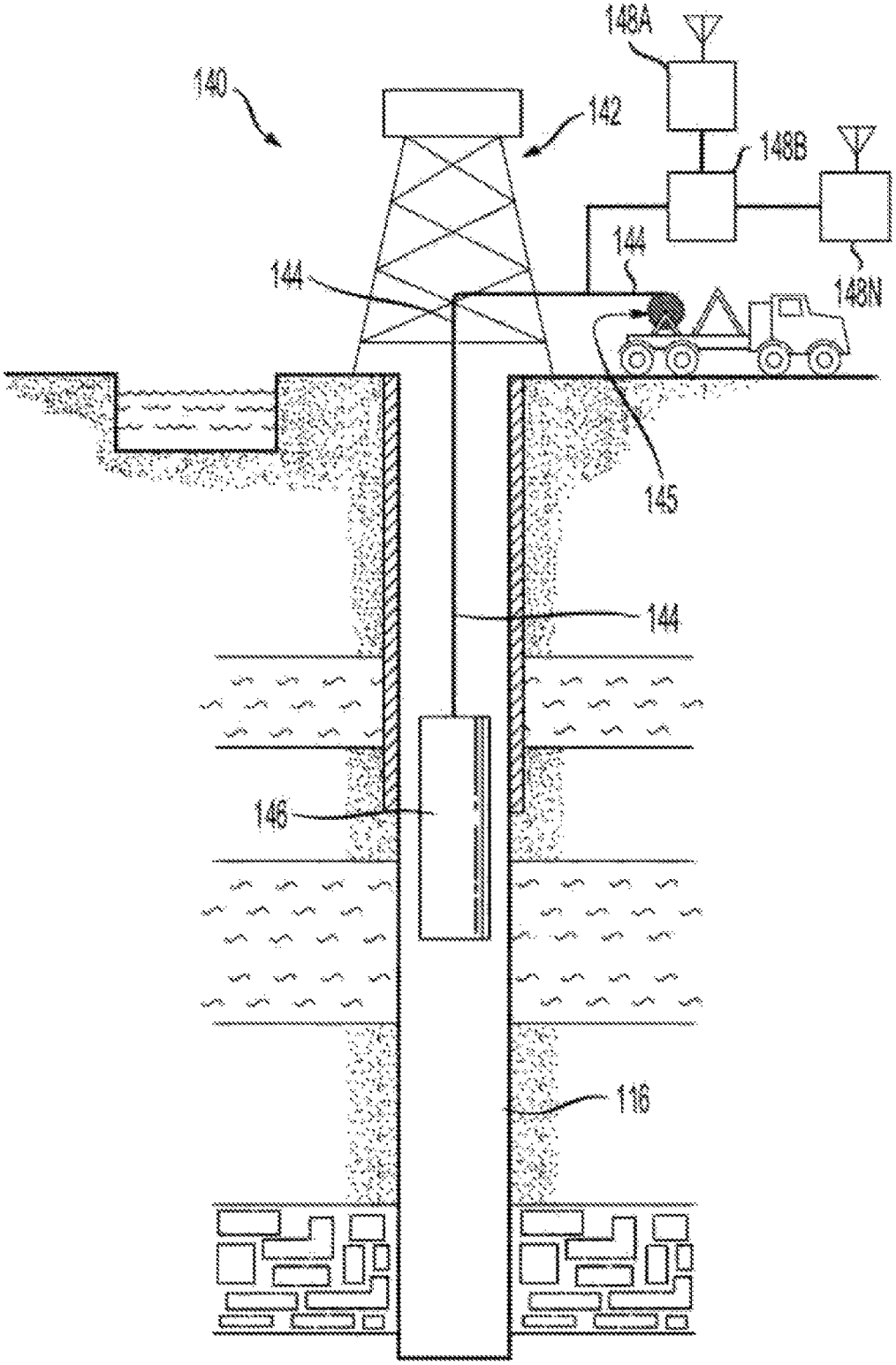
FIG. 1B is a schematic diagram of an example downhole environment having tubulars, in accordance with some examples.

Referring to FIG. 1B, an example system 140 for downhole line detection in a downhole environment having tubulars can employ a tool having a tool body 146 in order to carry out logging and/or other operations. For example, instead of using the drill string 108 of FIG. 1A to lower tool body 146, which may contain sensors or other instrumentation for detecting and logging nearby characteristics and conditions of the wellbore 116 and surrounding formation, a wireline conveyance 144 can be used. The tool body 146 can include a resistivity logging tool. The tool body 146 can be lowered into the wellbore 116 by wireline conveyance 144. The wireline conveyance 144 can be anchored in the drill rig 145 or a portable means such as a truck. The wireline conveyance 144 can include one or more wires, slicklines, cables, and/or the like, as well as tubular conveyances such as coiled tubing, joint tubing, or other tubulars.

The illustrated wireline conveyance 144 provides support for the tool, as well as enabling communication between tool processors 148A-N on the surface and providing a power supply. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more processors 148A-N, which can include local and/or remote processors. Moreover, power can be supplied via the wireline conveyance 144 to meet power requirements of the tool. For slickline or coiled tubing configurations, power can be supplied downhole with a battery or via a downhole generator.

Figure 2:
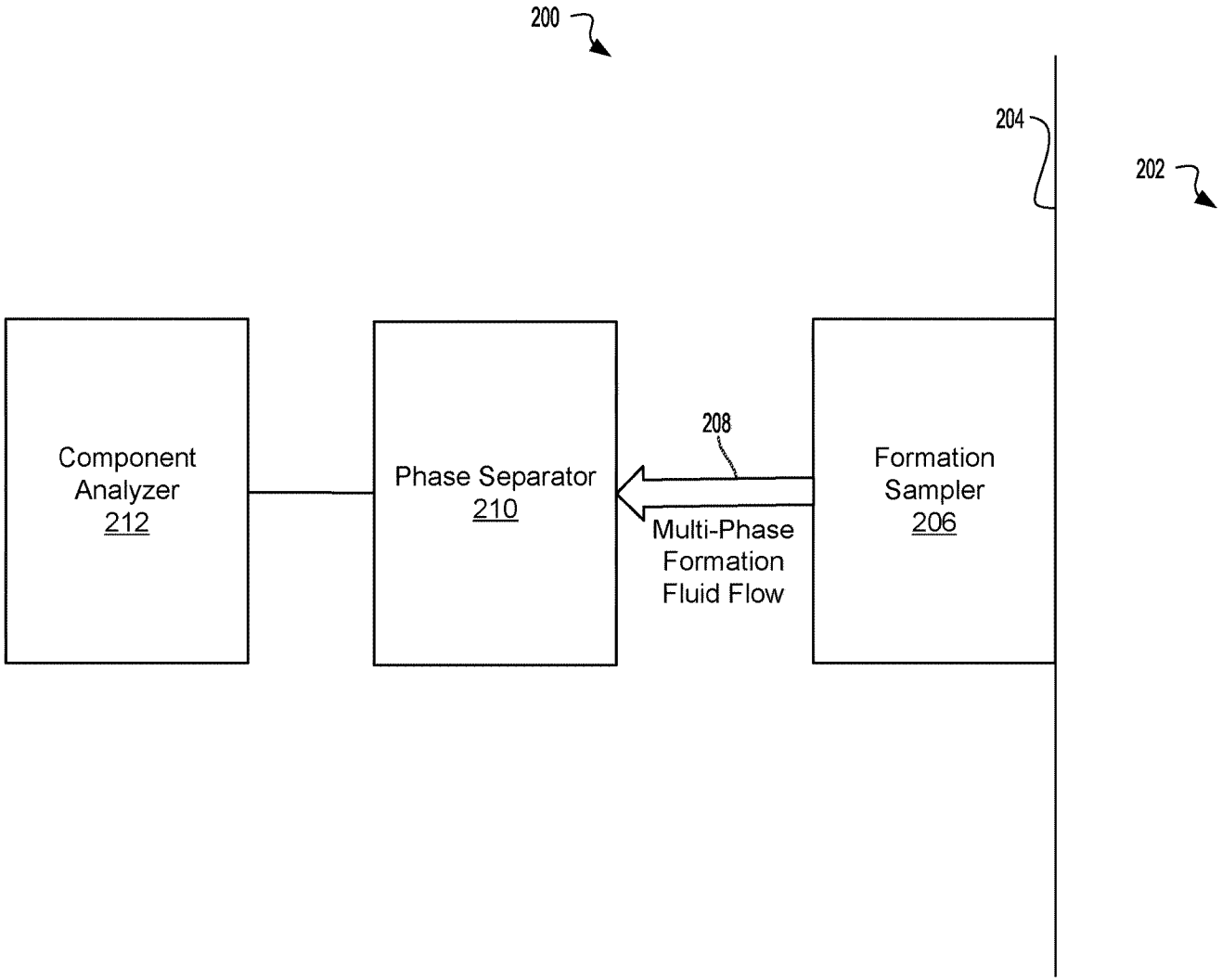
FIG. 2 illustrates a schematic representation of a system for separating phases of multi-phase formation fluid through affinity-based separation, in accordance with some examples.

The LWD and wireline environments shown in FIGS. 1A and 1B can be used to implement the systems and techniques described herein. FIG. 2 illustrates a schematic representation of a system 200 for separating phases of multi-phase formation fluid through affinity-based separation. The system 200 can be implemented through either of the LWD and wireline environments shown in FIGS. 1A and 1B.

The system 200 is disposed within a wellbore in a formation 202. Specifically, the system 200 is disposed in proximity to a wellbore wall 204 to sample formation fluid from the formation 202. The wellbore wall 204 can be either cased or uncased. The system 200 includes a formations sampler 206, a phase separator 210, and a component analyzer 212. While the components of the system 200 are shown as being disposed downhole, various components of the system 200 can be located at the surface. For example, the component analyzer 212 can be located at the surface for analyzing formation fluid that is sampled downhole and brought to the surface.

The formation sampler 206 functions to sample the formation 202 to gather multi-phase formation fluid. Specifically, the formation sampler 206 can gather multi-phase formation fluid from the formation 202 in a continuous flow during a test pump out of the formation 202. The formation sampler 206 can use applicable mechanisms and techniques for sampling formation fluid from the formation 202 as part of a continuous flow. For example, the formation sampler 206 can use probes that extend into the formation to draw formation fluid out from the formation 202. The multi-phase formation fluid can include an applicable combination of a flow of materials in two distinct phases. Specifically, the multi-phase formation fluid can be formed by a gas-liquid flow, a liquid-liquid flow, e.g. two immiscible liquid phases, and a liquid-solid flow. For example, the multi-phase formation fluid can be formed as part of an oil and water flow from the formation 202.

The phase separator 210 functions to receive a continuous flow of multi-phase formation fluid 208 from the formation sampler 206. In turn, the phase separator 210 can implement affinity-based separation to separate one or more phases from the continuous flow of multi-phase formation fluid 208. Specifically, the phase separator 210 can comprise one or more affinity-based separators that separate one or more phases from the continuous flow of multi-phase formation fluid 208. For example, the phase separator 210 can include an oil-specific affinity-based separator that is configured to separate an oil phase from the multi-phase formation fluid flow 208. In another example, the phase separator 210 can include a water-specific affinity-based separator that is configured to separate a water phase from the multi-phase formation fluid flow 208.

In separating phases from the multi-phase formation fluid flow 208, the phase separator 210 can continuously separate phases from the multi-phase formation fluid flow 208. Specifically, the phase separator 210 can separate phases from the multi-phase formation fluid flow 208 as the multi-phase formation fluid flow 208 is continuously sampled and input into the phase separator 210 from the phase formation sampler 206. Mechanical-based phase separators, on the other hand, can be unable to continuously separate phased from a multi-phase formation fluid. Specifically, mechanical-based phase separators can gather separate a portion of multi-phase formation fluid from a flow, and then perform phase separation as opposed to performing the phase separation in the flow of the formation fluid. Further, the phase separator 210 can separate phases from the multi-phase formation fluid flow 208 without fractionating or otherwise compositionally altering the phases of the multi-phase formation fluid flow 208. Specifically, the phase separator 210 can separate phases from the multi-phase formation fluid flow 208 while refraining from separating each individual phase into corresponding constituent components. This is contrast to mechanical-based separators that often fractionate and change the composition of a multi-phase formation fluid when separating phased from the fluid.

Affinity-based separators/filters, as used herein, can include separators that are of applicable design and comprise applicable materials for performing affinity-based separation. Affinity separation, as used herein, is based on selective and potentially reversible binding of a target substance or molecule. For example, the phase separator 210 can comprise an oil-specific affinity-based separator that utilizes either or both oleophobic or oleophilic components to separate oil from the multi-phase formation fluid flow 208. In another example, the phase separator 210 can comprise a water-specific affinity-based separator that utilizes either or both hydrophobic or hydrophilic components to separate water from the multi-phase formation fluid flow 208.

The affinity-based separators used herein can comprise one or more structures, e.g. membranes or layers, that perform affinity-based separation through fluid diffusion. For example, a water-specific affinity-based separator can comprise either or both hydrophobic layers/membranes or hydrophilic layers through which the multi-phase formation fluid flow 208 can pass in separating water from the multi-phase formation fluid flow 208. In another example, an oil-specific affinity-based separator can comprise either or both oleophobic layers/membranes or oleophilic layers through which the multi-phase formation fluid flow 208 can pass in separating oil from the multi-phase formation fluid flow 208. The layers/membranes described herein, e.g. with respect to affinity-based separation through diffusion, can be porous or semiporous membranes. Further, the layers/membranes can be hydrogels or other applicable polymer membranes.

Further, the affinity-based separators used herein can comprise one or more structures that perform affinity-based separation through fluid flow. Specifically, the affinity-based separators can include structures that have layers, e.g. coatings, that are sensitive to specific compositions and phases and can therefore perform affinity-based diffusion through flow of the phases over the structures. For example, a water-specific affinity-based separator can comprise structures with either or both hydrophobic coatings or hydrophilic coatings over which the multi-phase formation fluid flow 208 can flow in separating water from the multi-phase formation fluid flow 208. In another example, an oil-specific affinity-based separator can comprise structures with either or both oleophobic coatings or oleophilic coatings over which the multi-phase formation fluid flow 208 can flow in separating oil from the multi-phase formation fluid flow 208.

The component analyzer 212 is communicatively coupled to the phase separator 210. Specifically, the component analyzer 212 can be directly coupled to the phase separator 210, e.g. in the downhole environment. Alternatively, the component analyzer 212 can be coupled to the phase separator while remaining at the surface, e.g. through the movement of fluid that is processed by the phase separator 210 from the downhole environment to the surface.

The component analyzer 212 functions to receive separated phases of the multi-phase formation fluid flow 208 that are processed by the phase separator 210 and determine characteristics of the separated phases. Characteristics of the separated phases can include applicable features that can be identified from the phases. For example, when the separated phased is water, then the component analyzer 212 can identify an ionic composition of the water, a resistivity of the water, a conductivity of the water, a salinity of the water, a capacitance of the water, a density of the water, absorption characteristics of the water, a viscosity of the water, or a combination of thereof. In another example, when the separate phase is oil, then the component analyzer 212 can identify a hydrocarbon composition of the oil, a level of contamination of the oil, characteristics of a contamination of the oil from a drilling fluid, or a combination thereof.

The phase separator 210 can be packaged as a separate sub-assembly of the system 200. Further, the phase separator 210 can be configured to separate a single phase of the multi-phase formation fluid flow 208 and the separated out single phase to the component analyzer 212, fluid line, or other applicable storage receptacle. Additionally, the phase separator 210 can be configured to divert the remaining multi-phase formation fluid flow 208 to a bypass line or back into the wellbore, after the single phase is separated.

Figure 3:
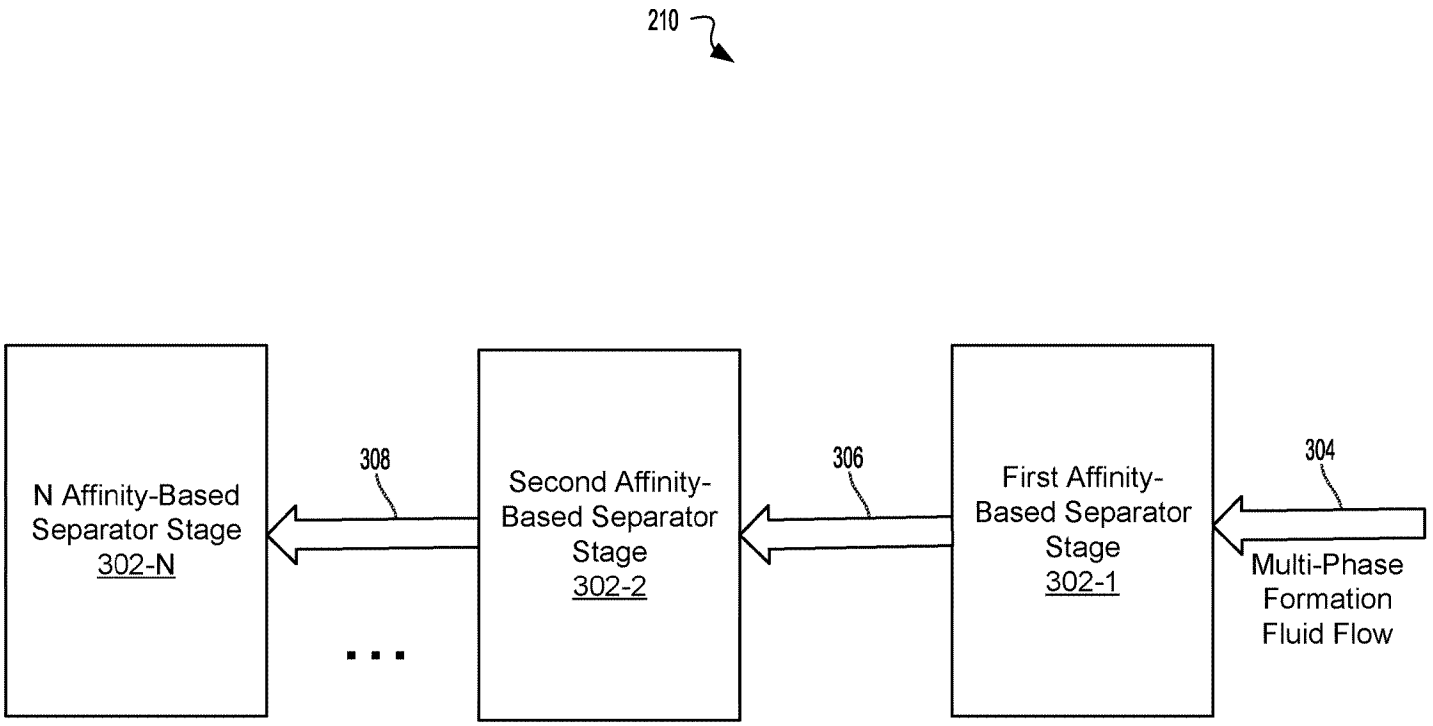
FIG. 3 illustrates a schematic representation of the phase separator that includes multiple affinity-based separator stages in series, in accordance with some examples.

The disclosure now continues with a discussion of various configurations of affinity-based separator stages in a multi separator configuration for performing affinity-based phase separation. Specifically, FIG. 3 illustrates a schematic representation of the phase separator 210 that includes multiple affinity-based separator stages in series. In the example shown in FIG. 3, the phase separator 210 includes a first affinity-based separator stage 302-1, a second affinity-based separator stage 302-2, to N affinity-based separator stage 302-N, herein collectively referred to as "affinity-based separator stages 302." Each of the affinity-based separator stages 302 can include one or more applicable affinity-based separators.

Each of the affinity-based separator stages 302 can be configured to separate a specific fluid from a multi-phase formation fluid input. For example, the first affinity-based separator stage 302-1 can be configured to separate water from the multi-phase formation fluid flow 304 that serves as input to the first affinity-based separator stage 302-1. Further, the second affinity-based separator stage 302-2 can be configured to separate oil from fluid that flows in to the second affinity-based separator stage 302-2. As the first and second affinity-based separator stages 302-1 and 302-2 are in series, then the output of the first affinity-based separator stage 302-1 can serve as input to the second affinity-based separator stage 302-2. In turn, the second affinity-based separator stage 302-2 can filter the flow from the processed flow of the first affinity-based separator stage 302-1 filtering the multi-phase formation fluid flow 304. For example, the first affinity-based separator stage 302-1 can first filter water from the multi-phase formation fluid flow 304 and the second affinity-based separator stage 302-2 can filter oil from the residual fluid.

The affinity-based separator stages 302 can be configured to operate at different flow rates. Further, the affinity-based separator stages 302 can be configured to operate at different flow pressures. The affinity-based separator stages 302 can be configured to operate at specific flow rates and flow pressures based on operation of the stages, e.g. the specific phases that are separated at the stages. Flow rates and flow pressures that are achieved at the stages 302 can be controlled or driven to achieve a specific flow rate and flow pressure at the stage. For example, a pump can be incorporated to cause a specific flow rate at the first affinity-based separator stage 302-1.

Figure 4:
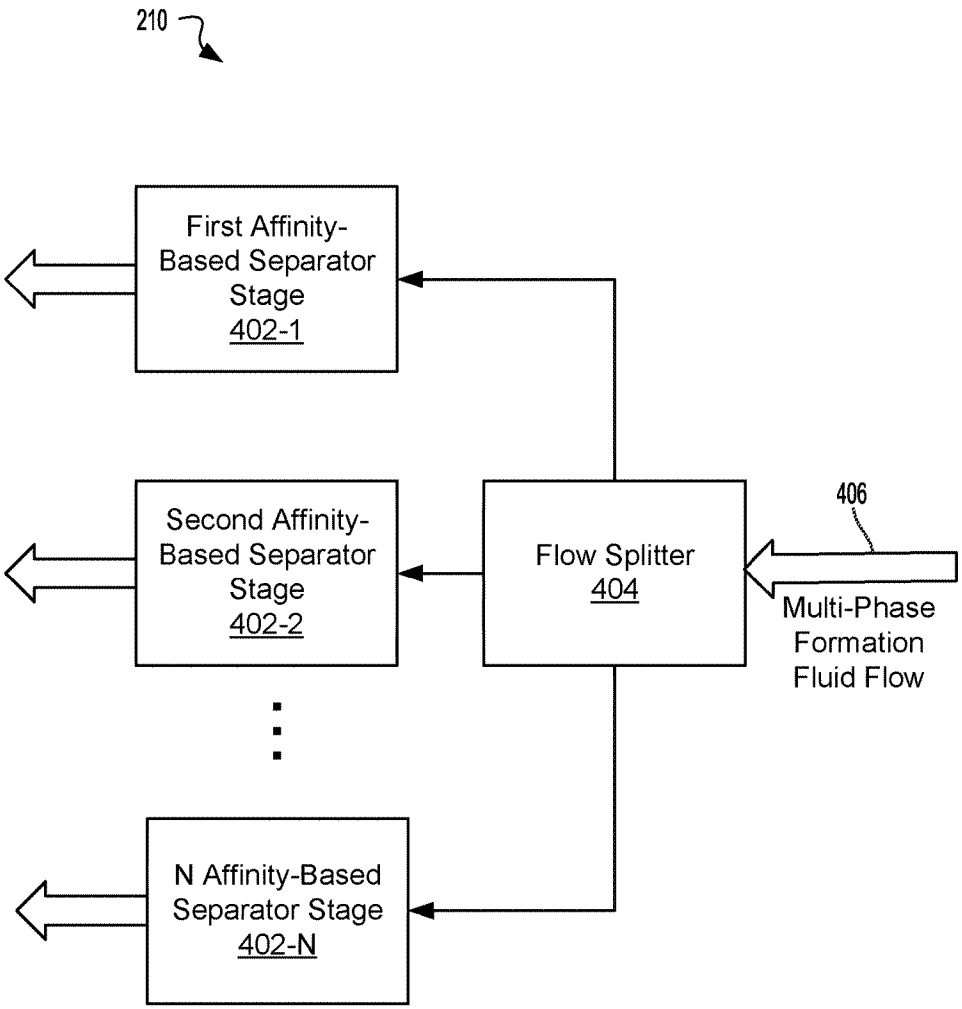
FIG. 4 illustrates a schematic representation of the phase separator that includes multiple affinity-based separator stages in parallel, in accordance with some examples.

FIG. 4 illustrates a schematic representation of the phase separator 210 that includes multiple affinity-based separator stages in parallel. In the example shown in FIG. 4, the phase separator 210 includes a first affinity-based separator stage 402-1, a second affinity-based separator stage 402-2, to N affinity-based separator stage 402-N, herein collectively referred to as "affinity-based separator stages 402." Each of the affinity-based separator stages 402 can include one or more applicable affinity-based separators.

Each of the affinity-based separator stages 402 are arranged in parallel with each other and with respect to a multi-phase formation fluid flow 406. Specifically, the affinity-based separator stages 402 are coupled to a flow splitter that splits the multi-phase formation fluid flow 406 into multiple flows that serve as inputs to corresponding stages of the affinity-based separator stages 402. As follows, the multiple flows can be processed by each of the corresponding affinity-based separator stages 302 to which the flows serve as input.

The affinity-based separator stages 402 can be configured to separate a specific fluid from a multi-phase formation fluid input. For example, the first affinity-based separator stage 402-1 can be configured to separate water from input fluid from the multi-phase formation fluid flow 406. Further, the second affinity-based separator stage 402-2 can be configured to separate oil from input fluid from the multi-phase formation fluid flow 406.

The affinity-based separator stages 402 can be configured to operate at different flow rates. Further, the affinity-based separator stages 402 can be configured to operate at different flow pressures. The affinity-based separator stages 402 can be configured to operate at specific flow rates and flow pressures based on operation of the stages, e.g. the specific phases that are separated at the stages. Flow rates and flow pressures that are achieved at the stages 402 can be controlled or driven to achieve a specific flow rate and flow pressure at the stage. For example, a pump can be incorporated to cause a specific flow rate at the first affinity-based separator stage 402-1.

The stages described herein can be integrated with sensors at the stages. The sensors can characterize the fluid that is separated at the stages. Further, the sensors can be specific to the type of fluid that is separated at the stages. For example, a first stage that separates oil can be coupled to a sensor that can characterize the oil. In another example, a second stage that separates water can be coupled to a sensor that can characterize the water.

Valves can be used to move separated fluid from the separators and the stages within separators that are described herein. Specifically, check valves can be integrated with separators to move separated fluid away from the separator, e.g. once a threshold amount of separated fluid is generated at the separator. For example, oil that is separated and builds up at a stage can build up a backpressure. A check valve can be integrated in the stage to move oil from the stage once a threshold backpressure is achieved.

Figure 5:
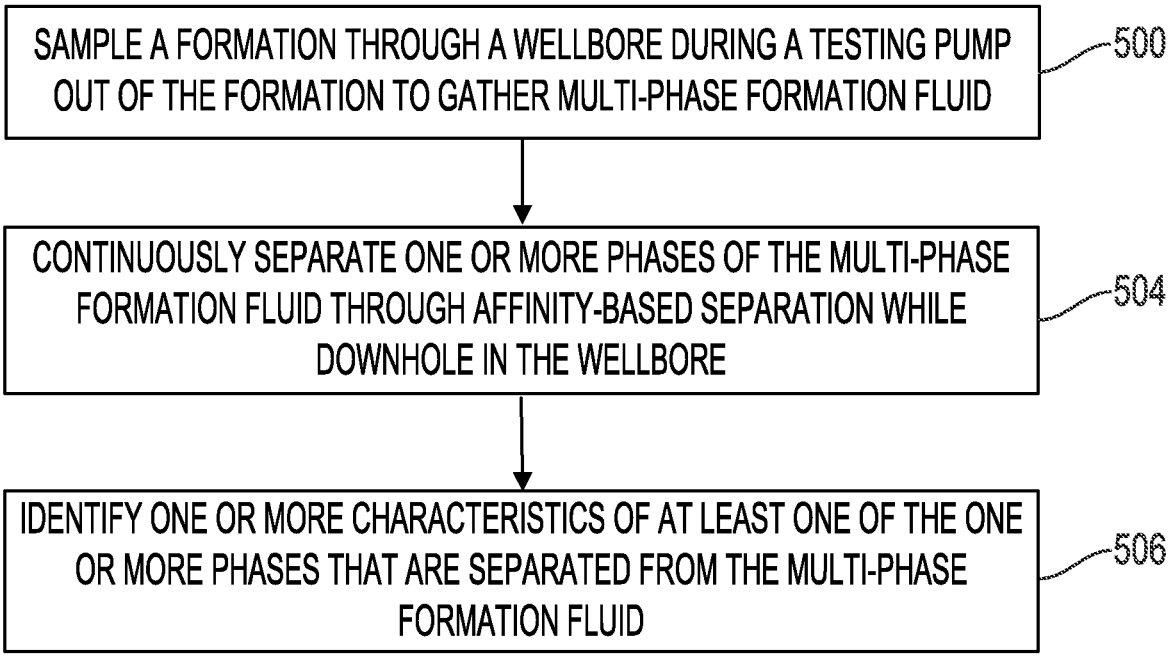
FIG. 5 illustrates a flowchart for an example method of performing-affinity based phase separation and characterization of the phase of a multi-phase formation fluid flow, in accordance with some examples.

FIG. 5 illustrates a flowchart for an example method of performing-affinity based phase separation and characterization of the phase of a multi-phase formation fluid flow. The method shown in FIG. 5 is provided by way of example, as there are a variety of ways to carry out the method. Additionally, while the example method is illustrated with a particular order of steps, those of ordinary skill in the art will appreciate that FIG. 5 and the modules shown therein can be executed in any order and can include fewer or more modules than illustrated. Each module shown in FIG. 5 represents one or more steps, processes, methods or routines in the method.

At step 500, a formation is sampled during a testing pump out of the formation to gather multi-phase formation fluid. Specifically, the formation can be sampled to create a multi-phase formation fluid flow.

At step 504, one or more phases of the multi-phase formation fluid are continuously separated through affinity-based separation while downhole in the wellbore. Specifically, one or more affinity-based separators can be exposed to the multi-phase formation fluid flow to continuously separate one or more phases from the fluid flow. More specifically, the multi-phase formation fluid flow can be exposed to one or more affinity-based separator stages to separate one or more phases from the fluid flow.

At step 506, one or more characteristics of at least one or more phases that are separated from the multi-phase formation fluid can be identified. Specifically, characteristics of at least one or more phases can be identified by an applicable system such as the component analyzer 212. Further, the characteristics of at least one or more phases can be identified through sensors that are coupled to affinity-based separator stages.

Figure 6B:
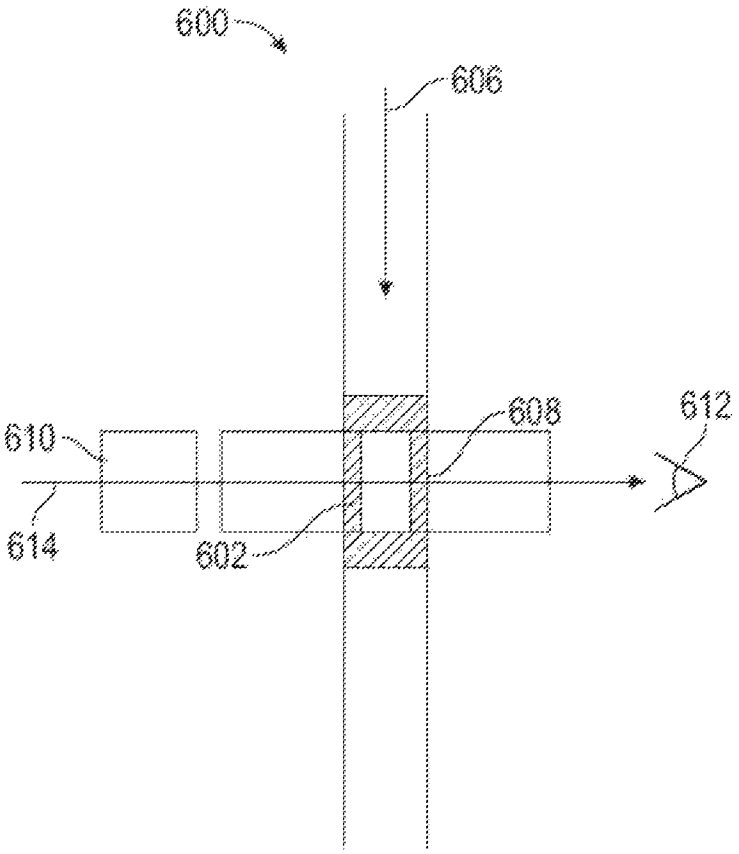
FIG. 6B illustrates a front cross-sectional representation of the example testing device.
Figure 6A:
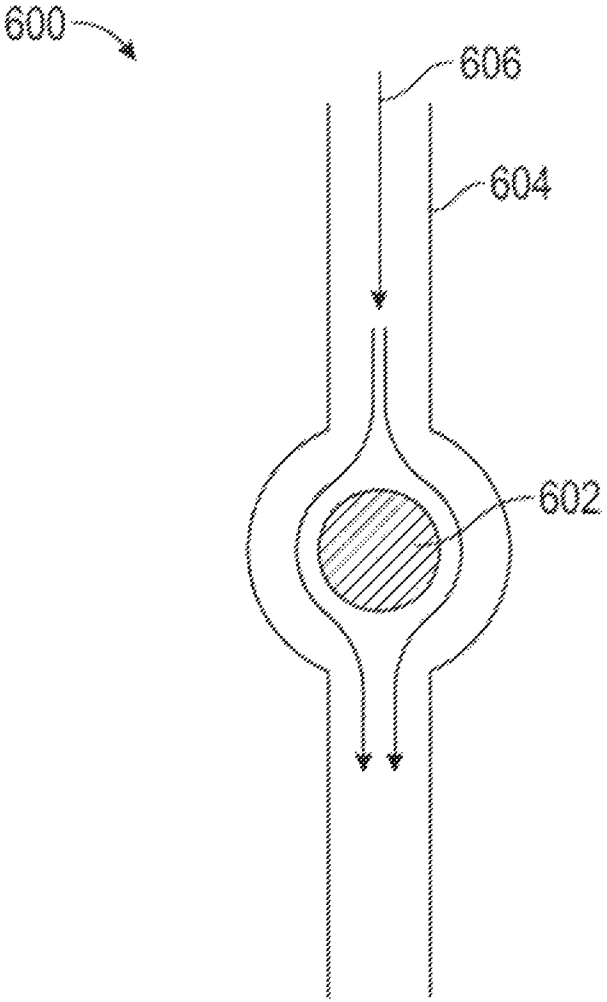
FIG. 6A illustrates a side cross-sectional representation of an example testing device.

The discussion now continues with a discussion of an example testing device. Specifically, FIG. 6A illustrates a side cross-sectional representation of an example testing device 600. FIG. 6B illustrates a front cross-sectional representation of the example testing device 600. The testing device 600 can include components that form part of an applicable system for separating phases of a multi-phase formation fluid, such as system 200. Specifically, the testing device 600 can form parts of the phase separator 210 and the component analyzer 212.

The testing device 600 comprises a separation substrate 604 put into a flow path 604 that defines a multi-phase formation fluid flow 606. The separation substrate 602 can be configured to separate a phase of the multi-phase formation fluid flow 606 according to the phase separators described herein. For example, the separation substrate 602 can include one or more affinity-based separators for separating phases of the multi-phase formation fluid flow 606. Specifically, the separation substrate 602 can form an enriched phase, including but not limited to enrichment of aqueous phase or enrichment of organic phase, that can be separated from the main multi-phase formation fluid flow 606.

The separation substrate 602 can separate an enriched phase to a region that is distinct from the flow path 604, otherwise referred to as an active area/path 608. The active path 608 may be drawn into a separate flow or collected in as a sample. The separate flow is distinct from the flow path 604 and can be use used in analyzing and/or directing the enriched phase. Further, the active area 608 may be probed through an applicable technique. For example, the testing device 600 can include a source 610 and a detector 612 that define a measurement path 614 in the active path 608. The source 610 and the detector can be used to analyze phase separated in the measurement path 614, for instance in order to determine the composition of the enrichment of the phase by monitoring at least one component or one property of the enriched phase. The detector 612 and source 610 may be sensitive to energy including but not limited to acoustic, electromagnetic, nuclear, and optical energy. The separation substrate 602 may be configured to be non-interactive with energy emitted by the source 610 substantially such that the energy does not damage the substrate or the substrate does not interfere with the measurement.

The separation substrate 602 and/or the active path 608 may be enhanced to respond to the component of interest in the enriched phase. The active path 608 may be actively pumped, drawn by capillary action, or diffused in order to flush the enriched phase across the active path area. The active area 608 and/or separation substrate 602 may be constructed to be sensitive to the components of interest that include but are not limited to ph, ion concentrations (Na+ K+, Ca(+2), Mg(+2), So4(−2), S (−2)), components including H2S, CO2, GOR, amines, amides, olefins, saturates, aromatics, resins, asphaltenes, methane, ethane, propane, butane, pentane, C6+. The measurement may be used to determine if the enrichment, or conversely the residual (the fluid that is left outside the enriched phase) may be suitable for collection. The measurement of the enriched phase may be used to optimize or adjust the enrichment process or the sample collection process including but not limited to by adjusting the pumping pressure, pumping speed, or stages of separation for multi stage separation. Measurement surfaces may also be introduced in contact along the active path 608, along the substrate 602, and/or within the active path 608 and the substrate 602. Such active measurement surfaces may be thin metal surfaces that are responsive to a component of the enriched phase by change in active surface properties that may be probed. Such an example may include a change in optical properties, resistivity/conductivity properties, or thermal properties such as may be detected by a thermal conductivity detector. Other surfaces may include catalytic surfaces, enzymatic surfaces, binding surfaces for which a change in the surface properties may be detected. Such metal surfaces as described may be gold, silver, copper, titanium, alloys, platinum.

Figure 7:
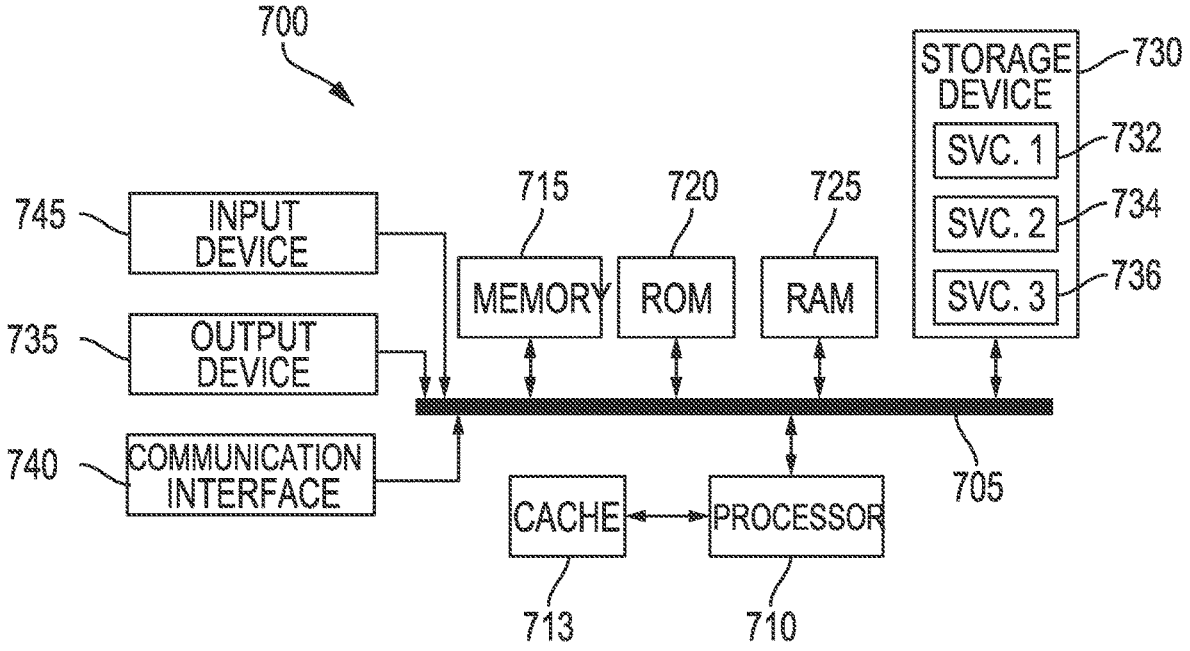
FIG. 7 illustrates an example computing device architecture which can be employed to perform various steps, methods, and techniques disclosed herein.

FIG. 7 illustrates an example computing device architecture 700 which can be employed to perform various steps, methods, and techniques disclosed herein. Specifically, the computing device architecture can be integrated with the electromagnetic imaging tools described herein. Further, the computing device can be configured to implement the techniques of controlling borehole image blending through machine learning described herein.

As noted above, FIG. 7 illustrates an example computing device architecture 700 of a computing device which can implement the various technologies and techniques described herein. The components of the computing device architecture 700 are shown in electrical communication with each other using a connection 705, such as a bus. The example computing device architecture 700 includes a processing unit (CPU or processor) 710 and a computing device connection 705 that couples various computing device components including the computing device memory 715, such as read only memory (ROM) 720 and random access memory (RAM) 725, to the processor 710.

The computing device architecture 700 can include a cache of high-speed memory connected directly with, in close proximity to, or integrated as part of the processor 710. The computing device architecture 700 can copy data from the memory 715 and/or the storage device 730 to the cache 713 for quick access by the processor 710. In this way, the cache can provide a performance boost that avoids processor 710 delays while waiting for data. These and other modules can control or be configured to control the processor 710 to perform various actions. Other computing device memory 715 may be available for use as well. The memory 715 can include multiple different types of memory with different performance characteristics. The processor 710 can include any general purpose processor and a hardware or software service, such as service 1 732, service 2 734, and service 3 736 stored in storage device 730, configured to control the processor 710 as well as a special-purpose processor where software instructions are incorporated into the processor design. The processor 710 may be a self-contained system, containing multiple cores or processors, a bus, memory controller, cache, etc. A multi-core processor may be symmetric or asymmetric.

To enable user interaction with the computing device architecture 700, an input device 745 can represent any number of input mechanisms, such as a microphone for speech, a touch-sensitive screen for gesture or graphical input, keyboard, mouse, motion input, speech and so forth. An output device 735 can also be one or more of a number of output mechanisms known to those of skill in the art, such as a display, projector, television, speaker device, etc. In some instances, multimodal computing devices can enable a user to provide multiple types of input to communicate with the computing device architecture 700. The communications interface 740 can generally govern and manage the user input and computing device output. There is no restriction on operating on any particular hardware arrangement and therefore the basic features here may easily be substituted for improved hardware or firmware arrangements as they are developed.

Storage device 730 is a non-volatile memory and can be a hard disk types of computer readable media which can store data that are accessible by a computer, such as magnetic cassettes, flash memory cards, solid state memory devices, digital versatile disks, cartridges, random access memories (RAMs) 725, read only memory (ROM) 720, and hybrids thereof. The storage device 730 can include services 732, 734, 736 for controlling the processor 710. Other hardware or software modules are contemplated. The storage device 730 can be connected to the computing device connection 705. In one aspect, a hardware module that performs a particular function can include the software component stored in a computer-readable medium in connection with the necessary hardware components, such as the processor 710, connection 705, output device 735, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the Disclosure Include:

Statement 1: A system comprising: a formation sampler that samples a formation to gather multi-phase formation fluid in a continuous flow through a wellbore during a testing pump out of the formation; and a phase separator comprising one or more affinity-based separators that continuously separates one or more phases of the multi-phase formation fluid through either or both diffusion or flow while downhole in the wellbore during the testing pump out.

Statement 2: A system according to Statement 1, further comprising a component analyzer that identifies one or more characteristics of at least one of the one or more phases that are separated from the multi-phase formation fluid.

Statement 3: A system according to Statement 2, wherein a phase of the one or more phases comprises water and the one more characteristics of at least one of the one or more phases comprises an ionic composition of the water, a resistivity of the water, a conductivity of the water, a salinity of the water, a capacitance of the water, a density of the water, absorption characteristics of the water, a viscosity of the water, or a combination of thereof.

Statement 4: A system according to either of Statements 2 or 3, wherein a phase of the one or more phases comprises oil and the one more characteristics of at least one of the one or more phases comprises a hydrocarbon composition of the oil, a level of contamination of the oil, characteristics of a contamination of the oil from a drilling fluid, or a combination thereof.

Statement 5: A system according to any of Statements 1 through 4, wherein the one or more affinity-based separators comprise a water-specific separator that is either hydrophobic or hydrophilic.

Statement 6: A system according to Statement 5, wherein the water-specific separator comprises a hydrophobic coating or a hydrophilic coating disposed on a structure.

Statement 7: A system according to either Statements 5 or 6, wherein the water-specific separator comprises a hydrophobic layer or a hydrophilic layer.

Statement 8: A system according to any of Statements 1 through 7, wherein the one or more affinity-based separators comprise an oil-specific separator that is either oleophobic or oleophilic.

Statement 9: A system according to Statement 8, wherein the oil-specific separator comprises an oleophobic coating or an oleophilic coating disposed on a structure.

Statement 10: A system according to either Statements 8 or 9, wherein the oil-specific separator comprises an oleophobic layer or an oleophilic layer.

Statement 11: A system according to any of Statements 1 through 10, wherein the one or more affinity-based separators form a single stage of the phase separator in continuously separating a phase of the multi-phase formation fluid.

Statement 12: A system according to any of Statements 1 through 11, wherein the one or more affinity-based separators comprise a plurality of affinity-based separators that each form a stage of a plurality of stages of the phase separator in continuously separating a phase of the multi-phase formation fluid.

Statement 13: A system according to Statement 12, wherein the plurality of stages comprise a first stage and a second stage that operate in parallel to continuously separate the one or more phases of the multi-phase formation fluid by receiving different input flows from the continuous flow of the multi-phase formation fluid.

Statement 14: A system according to either Statements 12 or 13, wherein the plurality of stages comprise a first stage and a second stage that operate in series to continuously separate the one or more phases of the multi-phase formation fluid, such that an output flow of the first stage forms an input flow of the second stage.

Statement 15: A system according to any of Statements 12 through 14, wherein the plurality of stages comprise a first stage and a second stage and the first stage and the second stage are maintained at either or both different flow rates and different flow pressures.

Statement 16: A system according to any of Statements 1 through 15, wherein the one or more affinity-based separators comprise one or more hydrogels.

Statement 17: A method comprising: sampling a formation through a wellbore during a testing pump out of the formation to gather multi-phase formation fluid in a continuous flow; and continuously separating, with one or more affinity-based separators, one or more phases of the multi-phase formation fluid through either or both diffusion or flow while downhole in the wellbore during the testing pump out.

Statement 18: A method according to Statement 17, further comprising identifying one or more characteristics of at least one of the one or more phases that are separated from the multi-phase formation fluid.

Statement 19: A method according to either Statement 17 or 18, wherein the one or more affinity-based separators comprise a water-specific separator that is either hydrophobic or hydrophilic.

Statement 20: A method according to any of Statements 17 through 19, wherein the one or more affinity-based separators comprise an oil-specific separator that is either oleophobic or oleophilic.

Statement 21: A method according to any of Statements 17 and 20, wherein the one or more affinity-based separators form a single stage of the phase separator in continuously separating a phase of the multi-phase formation fluid or the one or more affinity-based separators comprise a plurality of affinity-based separators that each form a stage of a plurality of stages of the phase separator in continuously separating a phase of the multi-phase formation fluid.

What is claimed is:

1. A system comprising:

a formation sampler that samples a formation to gather multi-phase formation fluid in a continuous flow through a wellbore during a testing pump out of the formation;

a phase separator comprising one or more affinity-based separators that continuously separates one or more phases of the multi-phase formation fluid through either or both diffusion or flow while downhole in the wellbore during the testing pump out;

wherein the one or more affinity-based separators comprise a plurality of affinity-based separators that each form a stage of a plurality of stages of the phase separator in continuously separating a phase of the multi-phase formation fluid; and wherein the plurality of stages comprise a first stage and a second stage that operate in parallel to continuously separate the one or more phases of the multi-phase formation fluid by receiving different input flows from the continuous flow of the multi-phase formation fluid.

2. The system of claim 1, further comprising a component analyzer that identifies one or more characteristics of at least one of the one or more phases that are separated from the multi-phase formation fluid.

3. The system of claim 2, wherein a phase of the one or more phases comprises water and the one more characteristics of at least one of the one or more phases is selected from the group consisting of an ionic composition of the water, a resistivity of the water, a conductivity of the water, a salinity of the water, a capacitance of the water, a density of the water, absorption characteristics of the water, a viscosity of the water, or a combination of thereof.

4. The system of claim 2, wherein a phase of the one or more phases comprises oil and the one more characteristics of at least one of the one or more phases is selected from the group consisting of a hydrocarbon composition of the oil, a level of contamination of the oil, characteristics of a contamination of the oil from a drilling fluid, or a combination thereof.

5. The system of claim 1, wherein the one or more affinity-based separators comprise a water-specific separator that is either hydrophobic or hydrophilic.

6. The system of claim 5, wherein the water-specific separator comprises a hydrophobic coating or a hydrophilic coating disposed on a structure.

7. The system of claim 5, wherein the water-specific separator comprises a hydrophobic layer or a hydrophilic layer.

8. The system of claim 1, wherein the one or more affinity-based separators comprise an oil-specific separator that is either oleophobic or oleophilic.

9. The system of claim 8, wherein the oil-specific separator comprises an oleophobic coating or an oleophilic coating disposed on a structure.

10. The system of claim 8, wherein the oil-specific separator comprises an oleophobic layer or an oleophilic layer.

11. The system of claim 1, wherein the one or more affinity-based separators form a single stage of the phase separator in continuously separating a phase of the multi-phase formation fluid.

12. The system of claim 1, wherein the plurality of stages comprise a first stage and a second stage that operate in series to continuously separate the one or more phases of the multi-phase formation fluid, such that an output flow of the first stage forms an input flow of the second stage.

13. The system of claim 1, wherein the one or more affinity-based separators comprise one or more hydrogels.

14. A method comprising:

sampling a formation through a wellbore during a testing pump out of the formation to gather multi-phase formation fluid in a continuous flow;

continuously separating, with one or more affinity-based separators, one or more phases of the multi-phase formation fluid through either or both diffusion or flow while downhole in the wellbore during the testing pump out;

wherein the one or more affinity-based separators comprise a plurality of affinity-based separators that each form a stage of a plurality of stages of the phase separator in continuously separating a phase of the multi-phase formation fluid; and wherein the plurality of stages comprise a first stage and a second stage that operate in parallel to continuously separate the one or more phases of the multi-phase formation fluid by receiving different input flows from the continuous flow of the multi-phase formation fluid.

15. The method of claim 14, further comprising identifying one or more characteristics of at least one of the one or more phases that are separated from the multi-phase formation fluid.

16. The method of claim 14, wherein the one or more affinity-based separators comprise a water-specific separator that is either hydrophobic or hydrophilic.

17. The method of claim 14, wherein the one or more affinity-based separators comprise an oil-specific separator that is either oleophobic or oleophilic.

18. The method of claim 14, wherein the one or more affinity-based separators form a single stage of the phase separator in continuously separating a phase of the multi-phase formation fluid or the one or more affinity-based separators comprise a plurality of affinity-based separators that each form a stage of a plurality of stages of the phase separator in continuously separating a phase of the multi-phase formation fluid.

* * * * *